United States Patent [19]

Carson et al.

[11] Patent Number: 4,550,455

[45] Date of Patent: Nov. 5, 1985

[54] SLOSH DAMPENING WASTE RECEPTACLE FOR CHAIRS FOR CARE OF INCONTINENT PERSONS

[75] Inventors: Donald W. Carson, Denver; Lee Penrose, Englewood, both of Colo.; Joseph E. Leich, Troy; William C. Caugherty, Utica, both of Mich.

[73] Assignee: Carson Medical Incorporated, Denver, Colo.

[21] Appl. No.: 548,227

[22] Filed: Nov. 2, 1983

[51] Int. Cl.[4] ..... A47K 11/06

[52] U.S. Cl. ..... 4/480; 4/478; 4/483; 297/348

[58] Field of Search ..... 4/478, 480, 483, 484, 4/144.1; 297/348

[56] References Cited

U.S. PATENT DOCUMENTS

| | | | |
|---|---|---|---|
| 393,991 | 12/1888 | Lisk | 4/483 |
| 576,398 | 2/1897 | Fortune | 4/483 |
| 932,910 | 8/1909 | Shaw | 4/483 |
| 2,913,732 | 11/1959 | Jones | 4/480 |
| 3,215,469 | 11/1965 | Wamsley | 297/348 |
| 3,271,785 | 9/1966 | DuBose | 4/480 |
| 3,341,864 | 9/1967 | Wichmann | 4/480 |
| 3,611,457 | 10/1971 | Wippich | 4/480 |
| 4,287,619 | 9/1981 | Brewer et al. | 4/483 |
| 4,296,506 | 10/1981 | Stoute, Sr. et al. | 4/478 |

*Primary Examiner*—Henry K. Artis

[57] ABSTRACT

A receptacle adapted to be disposed for receiving, by gravity, waste discharges from a person is an elongated container having an elongated aperture defined at the top thereof for receiving waste into the container. The container has side and end surfaces specially formed with concave surfaces to direct laterally-moving fluid waste in the container, the motion being caused by movement of the receptacle, in a generally upward direction, and the container has a portion for thereafter directing the fluid downward, back on itself to dampen sloshing or wave motion to prevent spillage and splashing. In another aspect, the receptacle is disposed in waste-receiving relationship to a person on a chair for an incontinent disabled person, the chair having an apertured cushion disposed over the receptacle which is mounted to be removed from the chair.

5 Claims, 25 Drawing Figures

FIG 4c
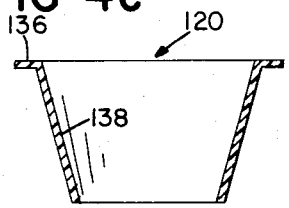
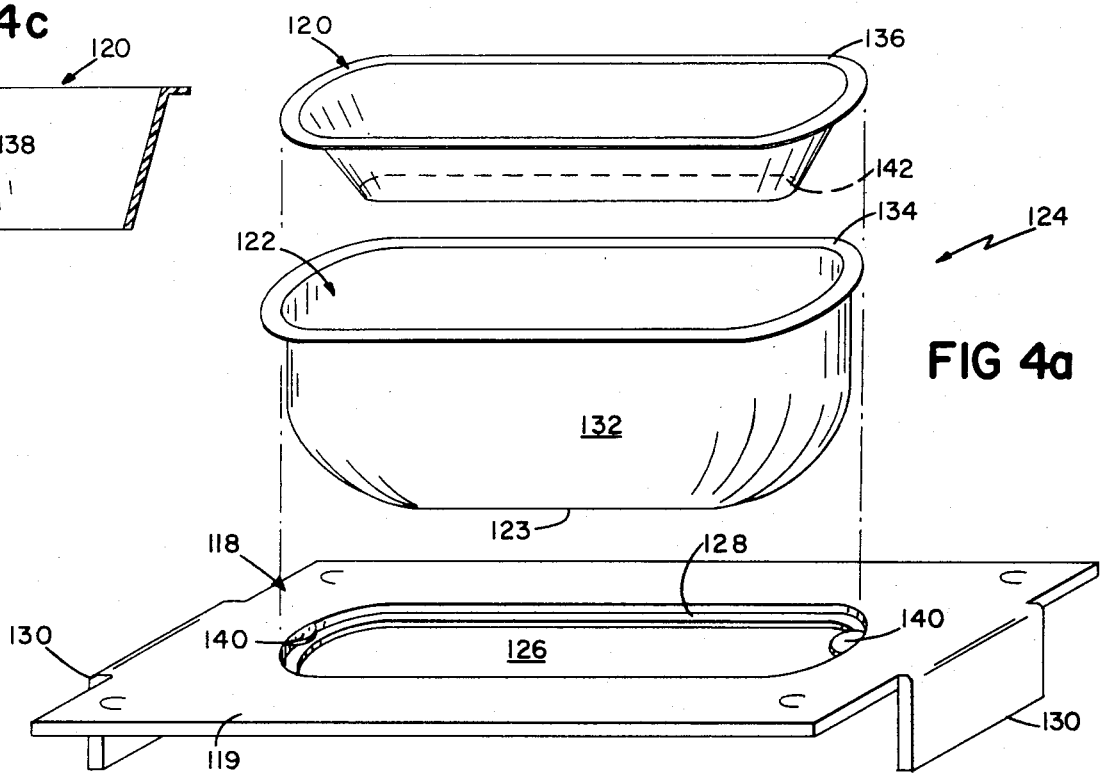
FIG 4a
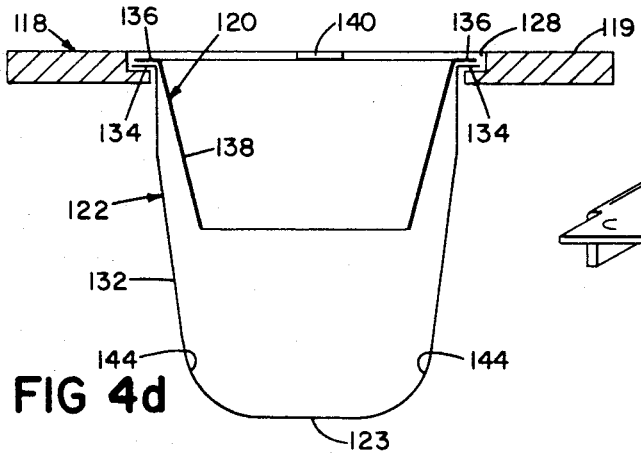
FIG 4d
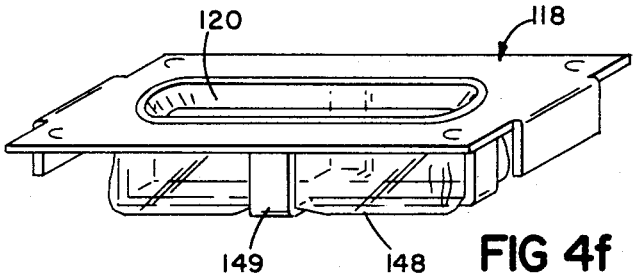
FIG 4f
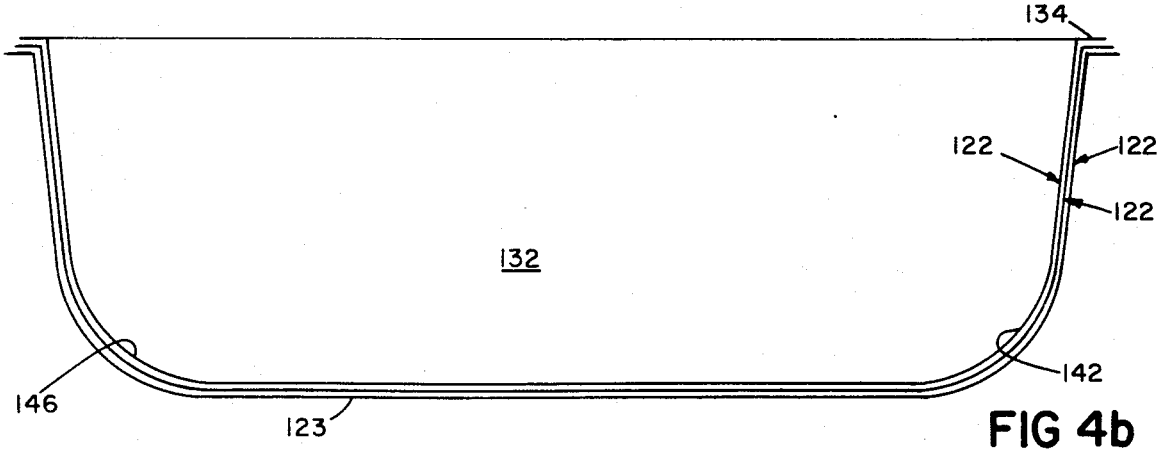
FIG 4b

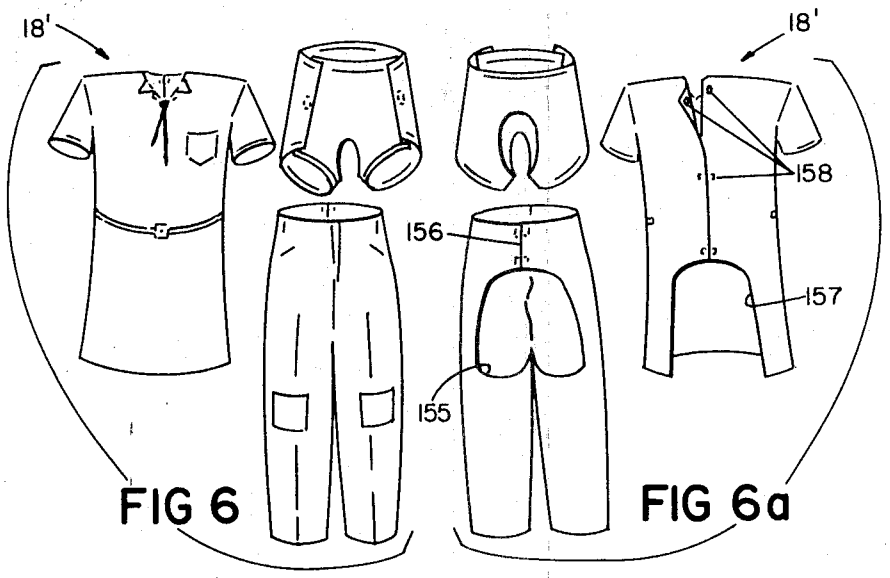
FIG 6a
FIG 6
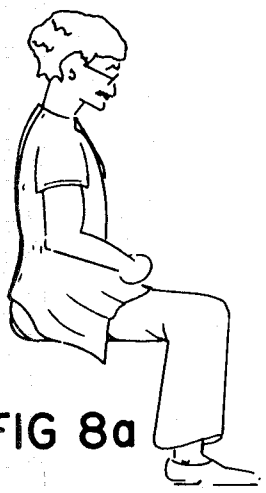
FIG 8a
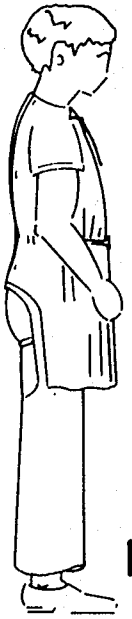
FIG 8
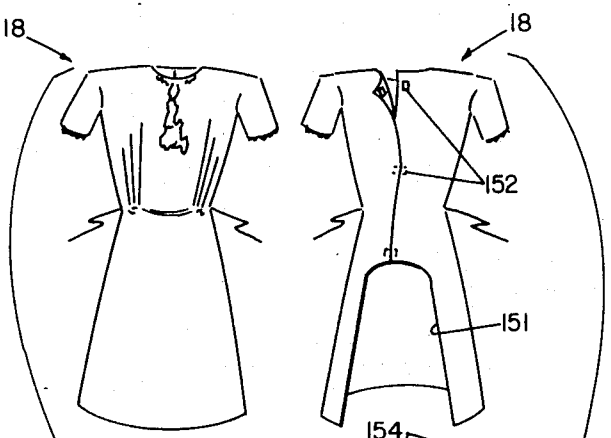
FIG 5a
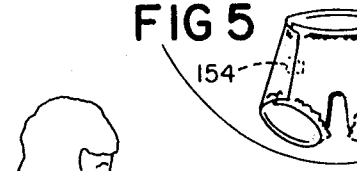
FIG 5
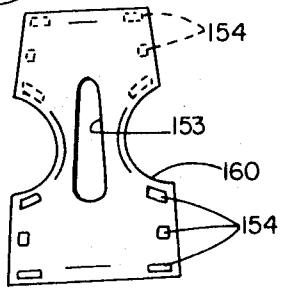
FIG 6b
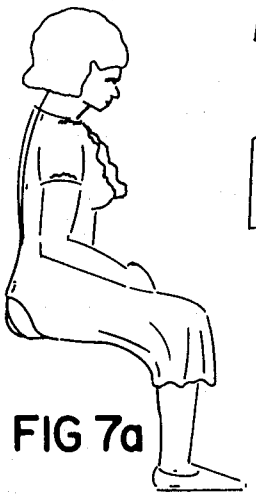
FIG 7a
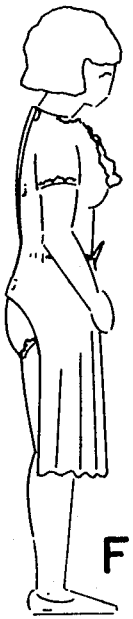
FIG 7

SLOSH DAMPENING WASTE RECEPTACLE FOR CHAIRS FOR CARE OF INCONTINENT PERSONS

BACKGROUND OF THE INVENTION

The invention relates to special discharge receiving receptacles for use with chairs adapted for care of incontinent patients and the like.

SUMMARY OF THE INVENTION

According to the invention, chairs for care of incontinent patients are equipped with a specially shaped receptacle for continuously receiving and holding waste discharges from the patient. For efficient use of attendant's time, it is desirable that such a receptacle have sufficient capacity to receive discharges over an extended period of time, and then be easy to handle for emptying without spilling. It is also desirable that chairs and especially wheelchairs equipped with such a receptacle be moveable without danger of the contents of the receptacle sloshing, spilling, or splashing onto the patient.

According to the invention, a receptacle adapted to be disposed for receiving, by gravity, waste discharges from a person comprises an elongated container having an aperture defined at the top thereof for receiving waste into the container, the container having side and end surfaces specially formed with concave surface to direct laterally-moving fluid waste in the container, the motion being caused by movement of the receptacle, in a generally upward direction, and the container having means for thereafter directing the fluid downward back onto itself to dampen sloshing or wave motion and prevent spillage and splashing.

In one preferred embodiment, the side surfaces of the container are generally of cylindrical form and the end surfaces are generally of spherical form. In other preferred embodiments, the means for thereafter directing the fluid downward comprise a deflector disposed relative to the concave surfaces in a manner to opposed the upwardly directed motion of the fluid therefrom; and the receptacle is comprised of separable components, at least one component being disposable, preferably the disposable component comprises the container which is configured and designed to be compactly stacked with a multiplicity of similarly-configured containers.

According to another aspect of the invention, a receptacle as has been described is provided in combination with a chair especially constructed for an incontinent, disabled person, comprising an apertured cushion disposed over the receptacle, the receptacle mounted to be removed from the chain, with the receptacle being disposed in waste-receiving relationship to the person and constructed and arranged to hold fluid discharges of the person over an extended period.

In one preferred embodiment of this aspect of the invention, the chair is a wheelchair with a seat comprised of a detachable compliant seat member and an underlying, substantially rigid support plate, both having elongated apertures corresponding to the aperture in the receptacle, which is slidably affixed beneath the supporting plate.

PREFERRED EMBODIMENT

We first briefly describe the drawings.

Drawings

FIG. 3 is an exploded view of the chair of FIG. 2, while

Figure 2:
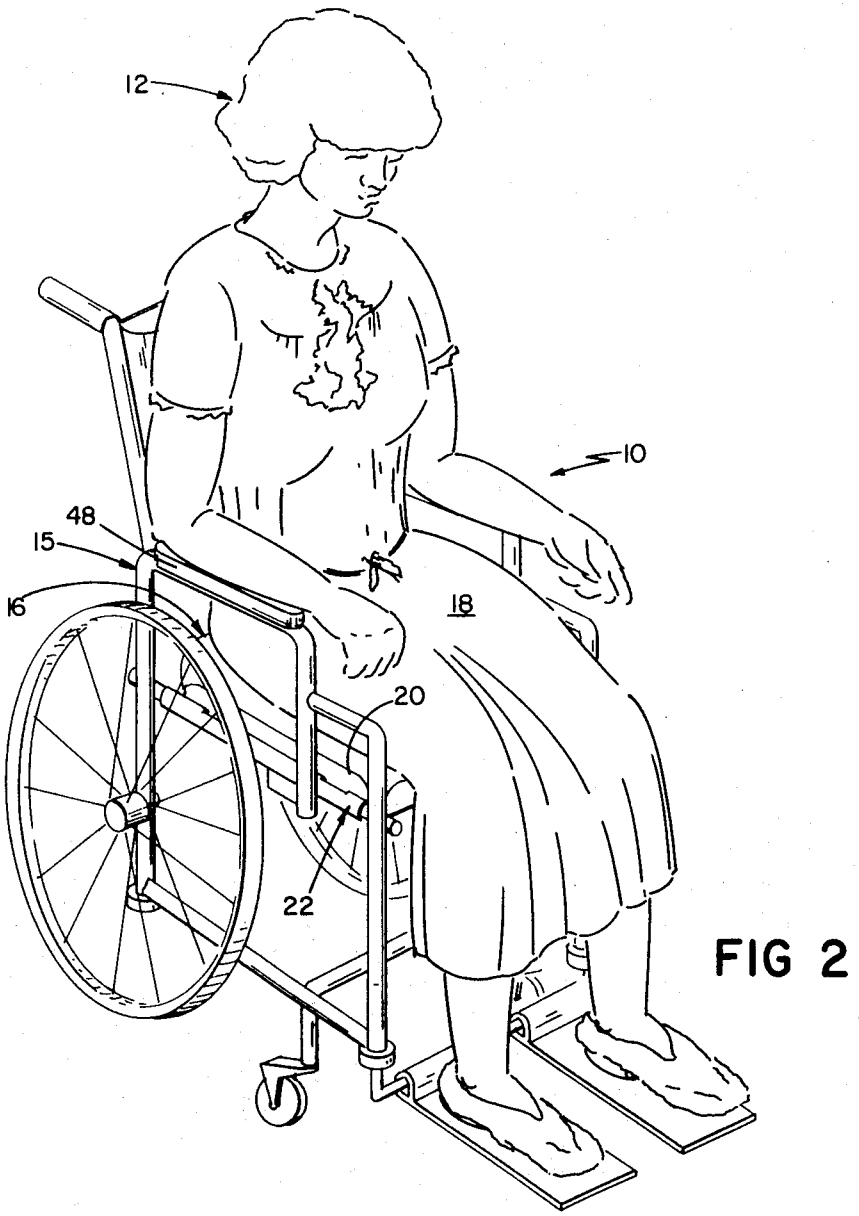
FIG. 2 is a perspective view of a similarly constructed wheelchair occupied by an incontinent patient attired in special clothing according to the invention.
Figure 3:
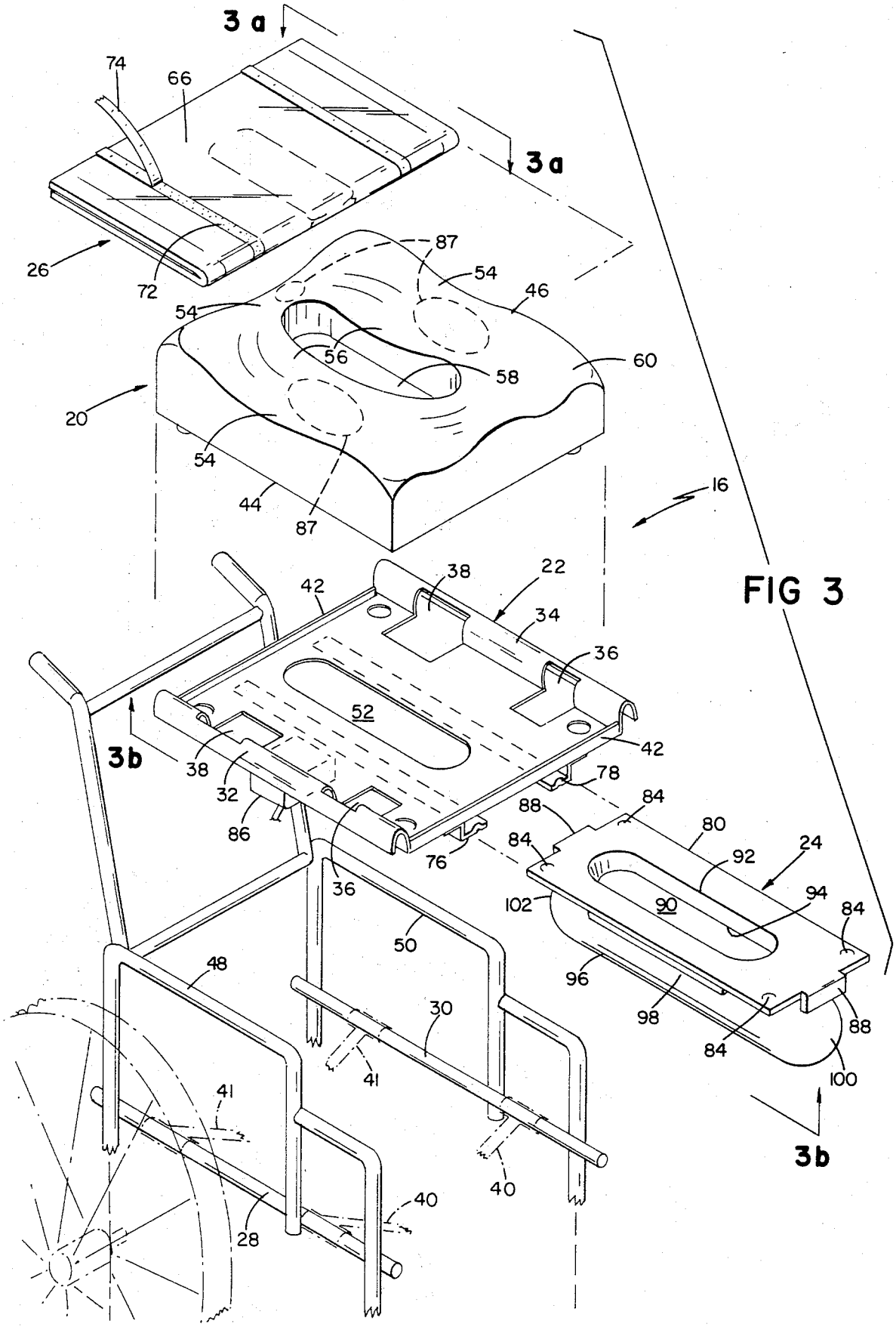
Figure 3A:
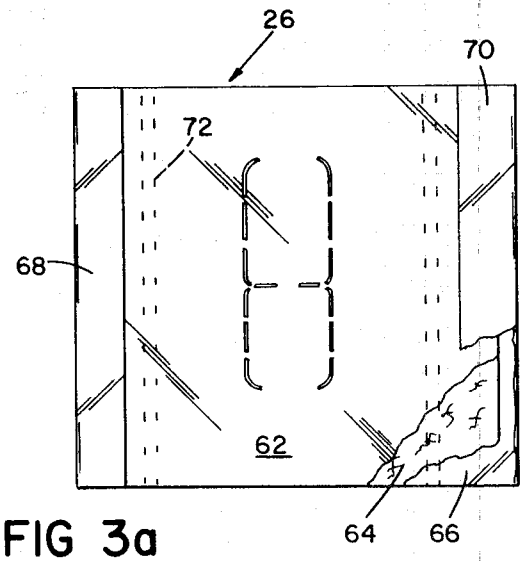
FIG. 3*a* is a plan view in section of the sheet form absorbent means and FIG. 3*b* is a bottom view of the seat support and receptacle taken generally at the lines 3*a*—3*a* and 3*b*—3*b*, respectively of FIG. 3.
Figure 3B:
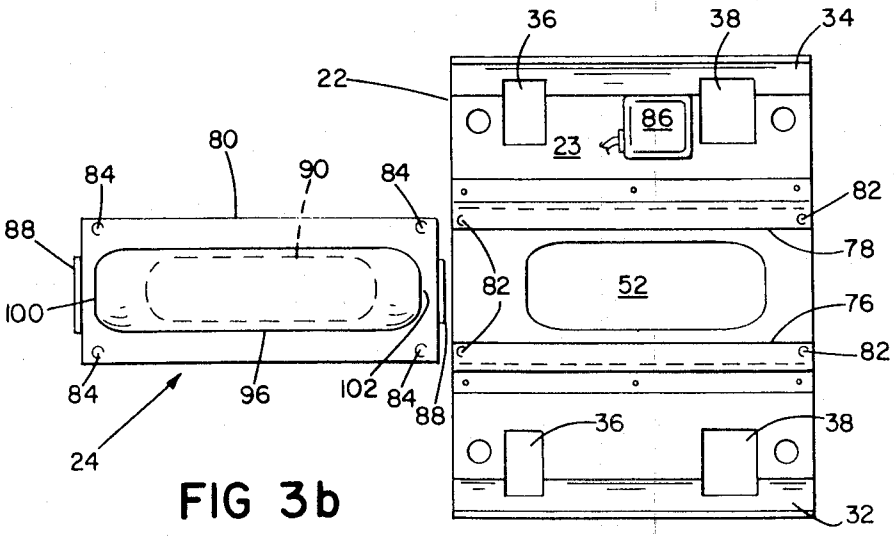
Figure 4:
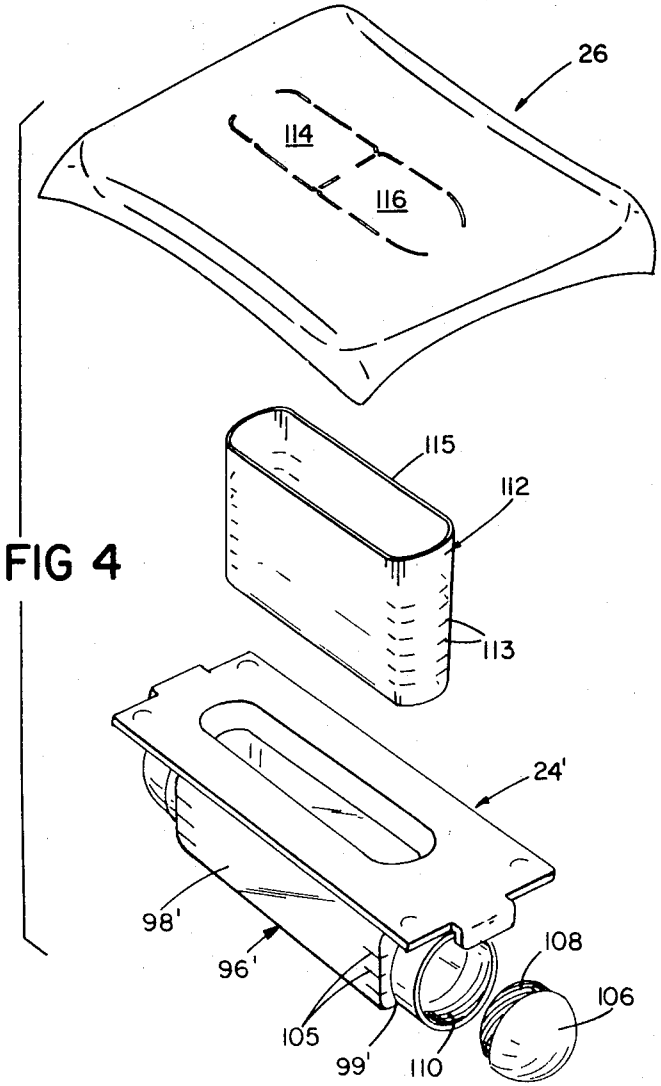
Figure 3C:
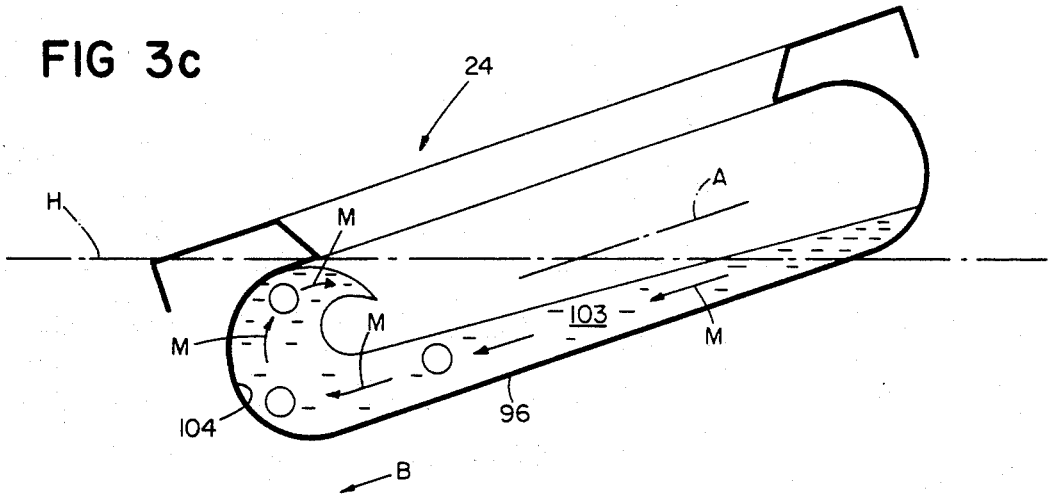
Figure 4E:
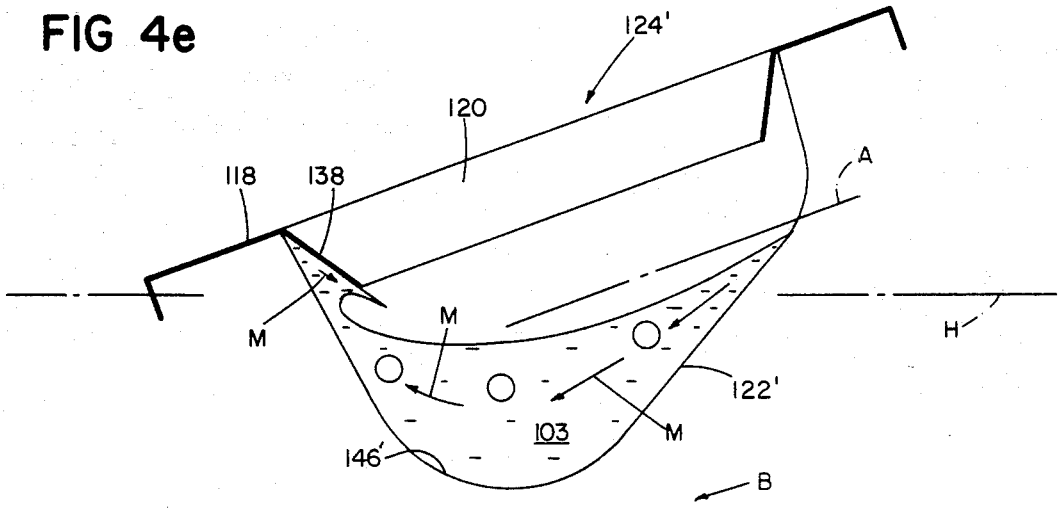
Figure 4G:
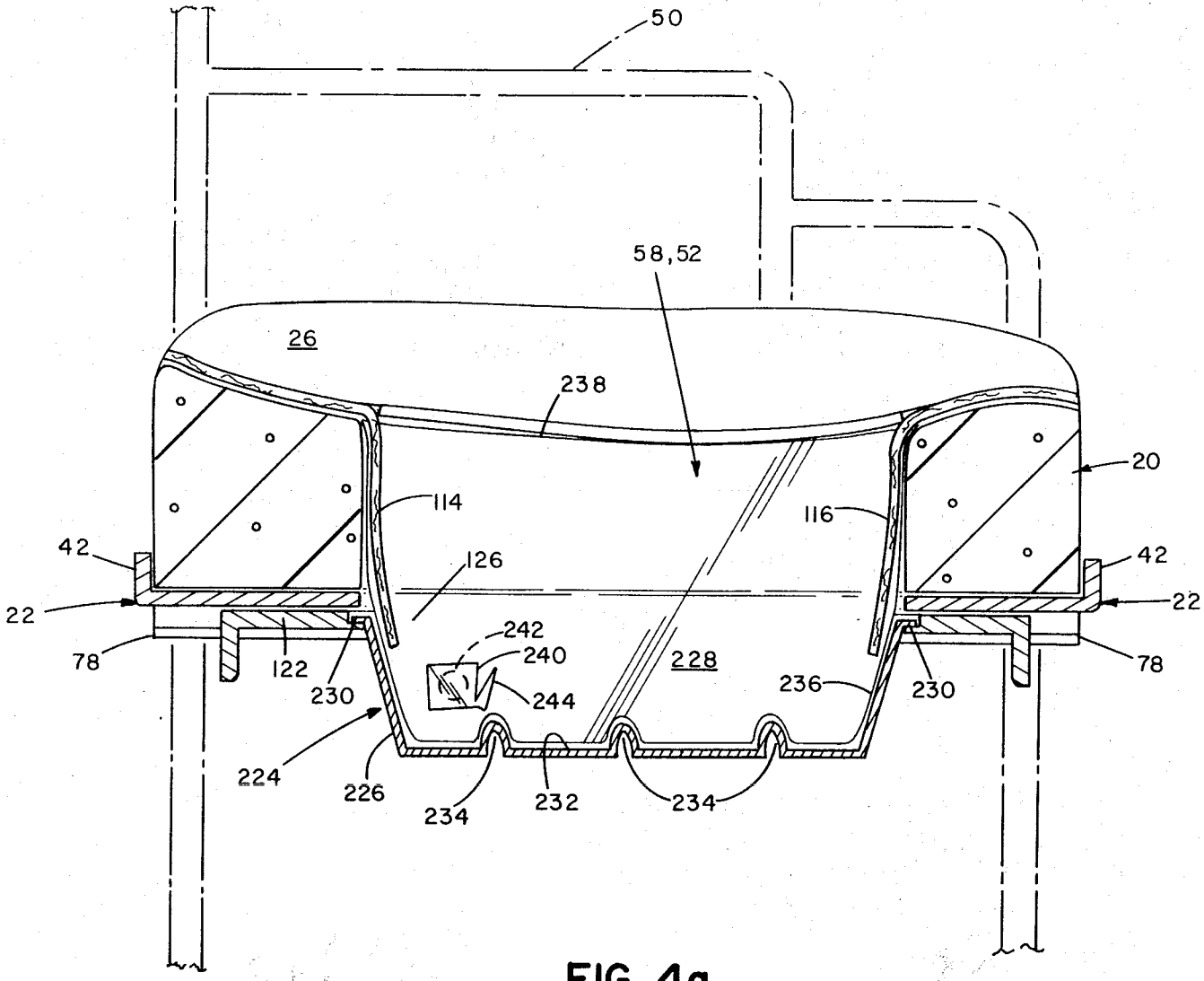
Figure 9A:
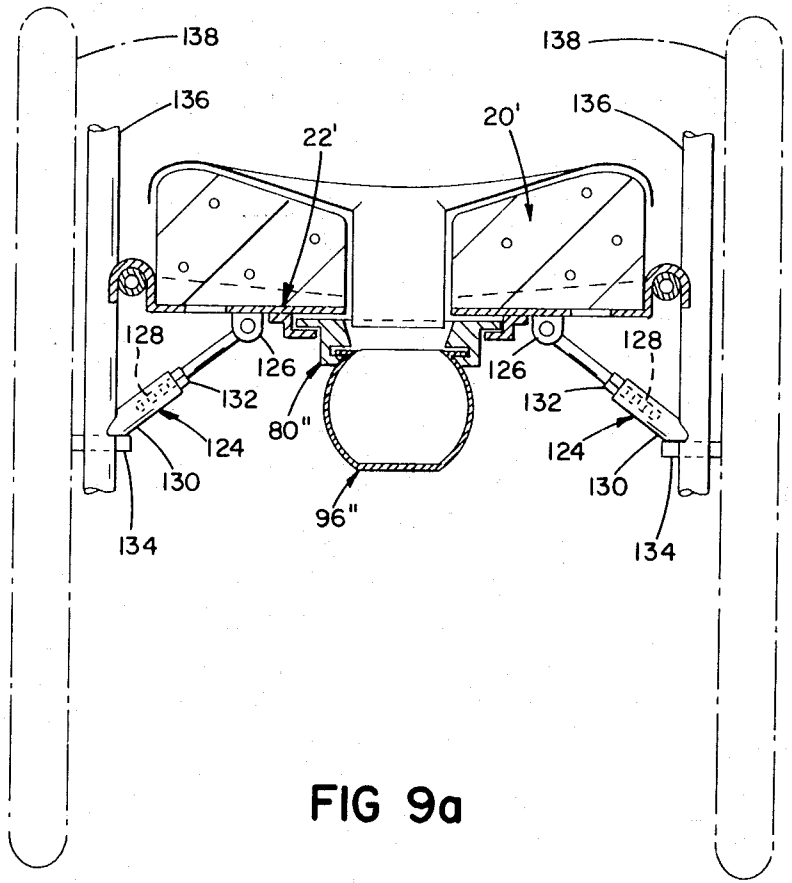
Figure 9:
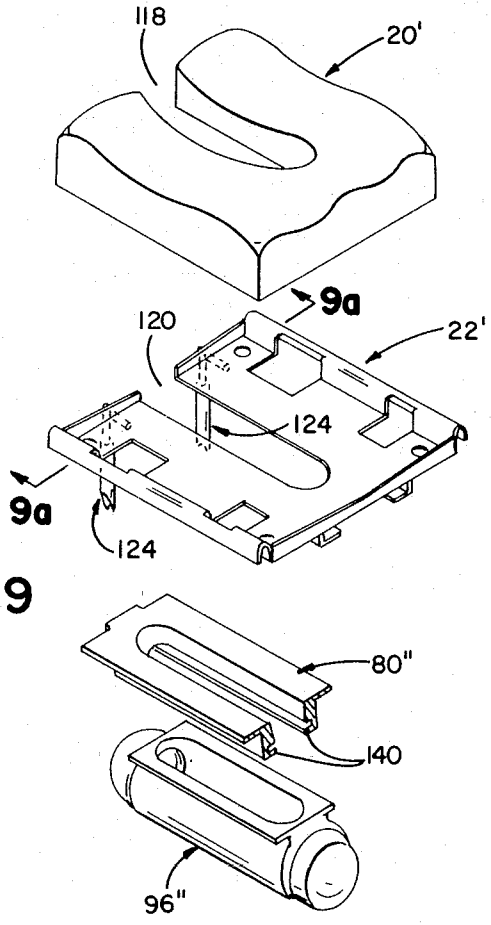

FIG. 3*c* is a side section view of the receptacle of FIG. 3 showing the slosh and wave-dampening effect of the design;

FIG. 4 is an exploded view of disposable elements of the system of the invention;

FIGS. 4*a* is an exploded view of another embodiment of a receptacle according to the invention, FIG. 4 is a side section view showing a stack of a multiplicity of the disposable waste-receiving pans of FIG. 4*a* is a side section view of the slosh deflector of FIG. 4*a*, and FIG. 4*d* is an end section view of the receptacle of FIG. 4*a* in assembled state;

FIG. 4*e* is a side section view of an alternate configuration of the receptacle of FIG. 4*a* showing the slosh and wave-dampening effect of the design;

FIG. 4*f* is a perspective view of another embodiment of a receptacle according to the invention;

FIG. 4*g* is a side section view of still another embodiment of the receptacle according to the invention, in place in an apertured seat;

FIGS. 5 and 5*a* are front and rear views, respectively, of women's apparel included in one embodiment of the system, while FIGS. 6 and 6*a* are similar views of men's apparel;

FIG. 6*b* is a plan view of the underclothing suitable for use by men or women;

FIGS. 7 and 7*a* show a woman patient attired in the apparel of FIGS. 5 and 5*a* in erect and seated position, respectively, and FIGS. 8 and 8*a* are similar views of a man;

FIG. 9 is an exploded view of the components of another embodiment of the seat according to the invention, while FIG. 9*a* is a section view of the assembled seat of FIG. 9 in the chair of FIG. 2, taken along the line 9*a*—9*a* of FIG. 9.

Figure 1:
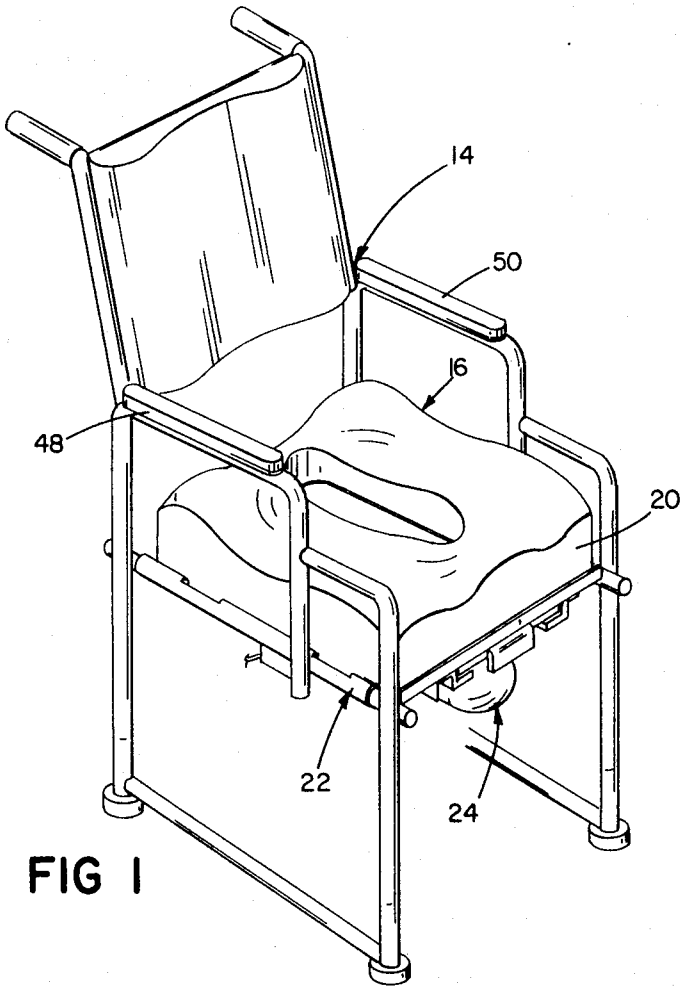
FIG. 1 is a perspective view of one embodiment of a special chair constructed according to the invention for enabling an incontinent, disabled person to approach a normal existence while the problem of incontinence is addressed.

Referring to FIGS. 1 and 2, the system 10 of the invention is employed to enable a disabled, incontinent patient 12 to approach a normal existence while permitting the problem of the patient's incontinence, i.e. lack of control of body evacuative functions, to be addressed. The system comprises a chair, in FIG. 1 a standard, stationary chair 14, in FIG. 2 a standard wheelchair 15, e.g. of the types known by tradenames such as Emerson-Jennings, Invacare and Theradyne, with a specially modified seat 16, including the novel waste-receiving receptacle 24, and special apparel 18, all discussed in more detail below.

Referring also to FIG. 3, seat 16, comprising seat cushion 20, seat support 22, receptacle 24 and absorbent seat cover 26, are shown in exploded view for ease of understanding.

The pre-existing seat of a standard chair, e.g in a wheelchair 15, the standard vinyl sling seat between support bars 28, 30, is removed. Stainless steel seat support plate 22 is installed in its place with deep, U-shaped formations 32, 24 removable engaged over bars 28, 30. The support plate 22 is easily removable, e.g. for use on collapsible wheelchairs. The support plate 22 defines forward and rear apertures 36, 38, respectively, at either side, which extend substantially to the top of formations 32, 34. The forward apertures 36 are configured to provide clearance for cross supports 40 found on typical Invacare-type wheelchairs. The rear apertures 38 are configured to provide clearance for cross supports 41 found on typical Emerson-Jennings and Theradyne-type wheelchairs. Thus the support is adapted for use on a large percentage of the wheelchairs currently in use in the United States. At the front and back of support 22 are upwardly extending lips 42 adapted to define, with formations 32, 34, a confined, recessed area to receive the base 44 of seat cushion 20. The planar surface of support 22 lies below the top of arms 28, 30, the therefore below the plane of the original seat, thus allowing increased thickness of cushion 20 without raising the height of the seat surface 46 and with it the vertical position of patient 12 relative to the fixed arm rests 48, 50, etc. Defined at the center of support 22 is elongated aperture 52 opening to receptacle 24, which will be discussed further below.

Cushion 20 is an open cell, highly resilient, molded polyurethane foam designed to provide a weight-distributing, compliant, contoured seat surface for the patient. The cushion has a special contour with raised outer portions 54 and depressed central portions 56 adjacent a central elongated aperture 58 which corresponds to aperture 52 in support 22. The contour is configured and designed to match the general posterior contour of a seated person, and is adapted to spread the person's weight to prevent occlusion of blood circulation in the capillaries of the flesh below the ischial protuberances. The seat cushion has a maximum uncompressed height of about three inches and a minimum height of about 2 inches under the same conditions. The cushion is provided in range of foam densities, e.g. between about 3 to 4 lbs/cu. ft., the exact density being selected, based upon the weight of the patient to occupy the chair, to provide complete support and to prevent the ischial and coccyx bones from bearing rigidly upon the support 22 through the cushion. The compliant nature of the seat cushion, and the liquid impervious coating 60 of highly flexible elastomeric material, e.g. urethane elastomer applied by in-the-mold coating technique to a thickness of about 0.001 to 0.002 inch, or vinyl, latex or natural rubber, serve to reduce skin-degenerating shear that occurs with normal patient motion on standard seats. The liquid impervious nature of the coatng also inhibits soiling and aids clean-up, although the seat cushion is easily removable and may be replaced as described.

The absorbent sheet 26 further serves to reduce soiling of the cushion 20, and also conducts fluid away from contact with the patient's flesh. Referring to FIGS. 3 and 3*a*, sheet 26, shown in top view in FIG. 3*a*, comprises multiple layers 62, 64 of absorbent material and a liquid-impervious sheet of thin plastic 66, e.g. polyethylene, therebeneath. Plastic sheet 66 is folded onto the upper surface to form flaps 68, 70 (FIG. 3*a*) extending at the side edge over the top of the absorbent layers. Sheet 26 is affixed to the surface 46 of cushion 20 by means of double-faced adhesive tape strips 72 exposed by removing release strips 74 (FIG. 3), with the liquid-impervious layer 66 in contact with the cushion. The absorbent layers are exposed to the patient's flesh to absorb any liquid discharge. The flaps 68, 70 also serve to keep absorbed fluid from migrating out of the edges of the sheet.

Referring now to FIG. 3*b*, affixed to the undersurface 23 of seat support plate 22 and Z-guides 76, 78 positioned to slidably receive top plate 80 of receptacle 24. Upwardly directly detents 82 are formed in guides 76, 78 to engage in similarly sized detents 84 in surface plate 80 In the figures, receptacle 24 is shown removed from the front for clarity. It is also removable from the rear as would be more typical with a patient seated in the chair.

Also affixed to the undersurface 23 of support plate 22 is pulsator 86, an electrically powered, rotating motor with an eccentric rotary weight which generates pulsating movement that is transmitted laterally through support plate 22. The beneficial pulsating motion thus spread throughout the bottom of the cushion is transmitted from the support plate 22 vertically through cushion 20 to the contacting flesh of the seated patient. The pulsating motion serves to aid blood circulation in the weight-supporting tissue, e.g. the ischial tissue in the buttocks region, to prevent bed sores.

Further comfort and bed-sore prevention is realized by special use of low-shear gel, as described by W. R. Spence in U.S. Pat. Nos. 3,308,491 and 3,663,973, both incorporated herein by reference. According to the present invention, special pockets of such gel are confined directly beneath maximum load-bearing points of the cushion, on either side of the waste-passing aperture. It is advantageous, for reasons of economy, that the regions of the cushion that receive less loading, or shear, are defined by foam cushioning in a composite construction. In other cases, the entire cushion surrounding the aperture may be comprised of a layer of the gel.

Referring again to FIG. 3, receptacle 24 comprises a plate 80 configured for sliding engagement within Z-guides 76, 78 in close surface-to-surface contact with the undersurface 23 of support plate 22. Receptacle 24 is positioned by means of front and rear tabs 88 to align elongated opening 90 with the corresponding elongated opening 52 in support plate 22. When proper alignment is achieved, interengagement of detents 82, 84 serves to hold the receptacle to prevent inadvertent shifting or misalignment of the receptacle openings, e.g. during movement of the chair. Below plate 80, the receptacle opening 90 is defined by rim 92 extending downward about 1 inch at an angle directed slightly inward, forming, at its lower lip 94, an elongated opening about 3 inches wide by about 14 inches long. Affixed below lip 94 is waste receptacle 96 having generally cylindrical body 98 and generally spherical end caps 100, 102. The transition of the walls of container 96 with lip 94 is smooth to avoid edges and crevices where waste might accumulate, and the smooth walls of container 96 curve concavely upwardly to dampen wave and sloshing effects in the collected waste, e.g. as may be caused by transporting a wheelchair equipped with the system over curbs, stairs, etc., or in handling the receptacle for emptying.

Referring to FIG. 3*c*, receptacle 24 is shown in cross-section. The axis A of the receptacle is angled at about 30° to the horizontal, H e.g. as when a wheelchair is transported over a curb. The receptacle is tipped backwards (indicated by arrow B) causing the liquid-and-solid waste 103 in container 96 to move rapidly, indicated by arrows M, toward the rear the container. The spherical surface 104 of the container directs the lead portion of the flow upwardly along the surface and back onto the top of the further flow. The back and downward force of the lead portion of the flow onto the following portion acts to dampen and deaden the sloshing effect and thus eliminate spillage or splashing and soiling of the patient through the receptacle opening. Both the ends and the sides of the container are similarly formed; however, as side-to-side wave and sloshing movement is less severe due to the relatively narrower confines of the container in the transverse direction, the side walls are required to apply less of the effect in that direction.

Referring now to FIGS. 4 and 4*a* through 4*g*, alternate forms of the receptacle system are shown.

In the embodiment of FIG. 4, receptacle 24' is blow-molded of a light-transmitting material, e.g. clear polypropylene, and is designed to be disposable, where desired. The container, visible below the seat, is marked volumetrically 105 to allow easy monitoring of the patient's fluid output. Also, container 96' is provided with plug 106 formed at one end having a male threaded portion 108. The body 98' has a correspondingly sized female threaded portion 110. Plug 106 is screwed into body 98' to form a liquid-tight seal. When it is desired to empty container 96', e.g. container 96' is sized to hold the waste for an entire day, typically about 40 ounces maximum, the receptacle 24' is removed from the chair, and plug 106 is removed to allow liquid-and-solid waste to be dumped from the container. The bottom surface of body 98' is slightly flattened at 99' to allow receptacle 24' to rest on a flat surface without spilling. A light gauge plastic bag 112 is provided to allow reuse of receptacle 96' with limited cleansing. Bag 112 is of pliant material which conforms to the sides of container 96' and does not adversely affect the wave-dampening effect of the shape of the receptacle. The bag is also marked volumetrically 113. The lip 115 of bag 112 extends upward through the receptacle opening in the seat support and seat cushion to contact the absorbent sheet 26. In some instances, it is desirable that sheet 26 and bag 112 be provided as a unit to form a liquid impervious cover between the seat and the patient to prevent soiling of cushion surfaces. Where a liner 112 is not used in this manner, receptacle-opening flaps 114, 116 hanging into the opening suspended from sheet 26 at the from and rear edges, respectively, protect the underlying areas of the cushion, e.g. during urination or explosion defecation.

Referring now to FIG. 4*a*, another embodiment of the receptacle is shown. Receptacle 124 comprises tray 118, slosh deflector 120 and waste-receiving pan 122. Tray 118 is typically a plate of molded plastic, e.g. 0.025 inch thick polyethylene, of size to be slideably received and supported by Z-guides 76, 78, e.g. about 5 to 6.5 inches wide by 11 inches long. Aperture 126, about 3 inches wide by 11 inches long, with 3 inch diameter semicircles at either end, is defined through tray 118, with counterbore 128, at least 0.25 inch wide defined from the top surface about the circumference of aperture 126. Front and rear tabs 130 permit the tray to be easily positioned in the Z-guides to align aperture 126 with the corresponding apertures 52, 58 of support plate 22 and cushion 20, respectively.

Waste-receiving pan 122 has body 132 sized to pass through aperture 126 and outwardly directed, circumferential flange 134 sized and adapted to sufficiently engage in counterbore 128 to support pan 122 hanging dependently therefrom, even when the pan, which is about 3.5 inches deep, is left in position to receive and hold the waste generated over an entire day, typically about 40 ounces. Pan 122 is blow molded or vacuum formed of transparent polyethylene, typically about 0.015 to 0.020 inch, and is intended to be fully disposable. For that reason, pan 122 is stackable with other pans of the same configuration, as shown in FIG. 4*b*, to allow a multiplicity of stacked pans 122 to occupy a relatively small volume.

Slosh deflector 120, shown in cross section in FIG. 4*c*, comprises an annular collar with an outwardly directed flange 136 of dimension similar to that of flange 134 on pan 122. Deflector plate 138 extends downwardly approximately 1.75 inches at an inwardly directed angle of about 15° or more to the sidewall.

Receptacle 124 is assembled by passing the body 132 of an 122 through aperture 126 of tray 118 until flange 134 rest in counterbove 128. (The generally vertical surfaces of pan 122 are tapered inwardly toward the base at an angle of about 5° to 10° to facilitate insertion of pan 122 into tray 118, and also to facilitate stacking.) Deflector 120 is placed in tray 118, with flange 136 resting in counterbore 128 on flange 134, with plate 138 extending into the volume of pan 122. Cam hinges 140 are rotated to pinch downward onto the surface of flange 136 to fix the assembly as a unit, with the hinges and flanges below the top surface 119 of tray 118 to allow clearance with the undersurface of plate 22. The assembled receptacle is then slid on Z-guides 76, 78 to properly position receptacle opening 142. Waste discharged by the incontinent patient in the chair passes by gravity through elongated apertures 58, 52, 142 in succession into pan 122.

The bottom 123 of pan 122 is flat to allow the receptacle 124 to rest on a flat surface. However, the lower portion of the sides and ends of the pan are configured to provide smooth curves of maximum possible radius, e.g., for the dimensions mentioned above, the radius of the side surfaces 144 (FIG. 4*d*) is about 1.5 inches while the radius of the end surfaces 146 (FIG. 4*b*) is about 2 inches. This provides a smooth transition from horizontal, i.e. front-to-back and side-to-side, movement to vertical movement of waste in the container, e.g. caused by movement of the patient in the chair or by movement of the chair. (The pan configuration in FIG. 4*a* is specifically for use of flat surfaces or slight ramps. A special configuration for more extreme conditions is shown in FIG. 4*e*, discussed below.) The waste fluid directed smoothly upward by the configuration of the wall surfaces confined by strike the undersurface of slosh deflector 120 which directs any impinging fluid downward, back into the pan. Thus the waste fluid is prevented from splashing or sloshing out of the pan onto the patient. This effect is shown most clearly in FIG. 4*e*. Receptacle 124' includes pan 122' specially configured for more active use, e.g. in a wheelchair where curbs and stairs are to be surmounted. Tray 118 and slosh deflector 120 are as described above. Pan 122' is slightly shallower at the front, e.g. about 2 inches deep, and significantly deeper at the rear, e.g. about 4.5 inches deep, to accomodate tipping when the wheelchair is maneuvered. Receptacle 124' is assembled and positioned in guides 76, 78 as described above. When the axis A of receptacle 124' is angled at about 30° to the horizontal, H, liquid-and-solid waste 103 moves rapidly, indicated by arrows M, toward the deeper, rear portion of pan 122'. Curved surface 146' smoothly changes the direction of flow of fluid 103 from rearwardly to upwardly into a region where it is confined by the under surface of deflector plate 138. Deflector plate 138 directs the fluid down into pan 122 thus reducing sloshing and splashing and preventing soiling of the seated person.

Referring to FIG. 4*f*, another embodiment employing a tray 118 and deflector 120, generally of the construction discussed, above is shown. Pan 122 is replaced with a thin walled, pliant plastic, e.g., polyethylene, bag 148 which is totally disposable. The upper lip of bag 148 extends between the counter bore surface of tray 118 and flange 136 of deflector 120 to be held by pressure on hinges 140. The lower portion of bag 148 is supported by frame 149.

Referring now to FIG. 4*g*, still another embodiment of the waste-receiving receptacle and associated accessories is shown. Receptacle 224 comprises pan 226 having a body 228 and an outwardly-directed, circumferential flange 230. The body and flange are sized to fit and be secured in aperture 126 of tray 122 as described above. Pan 226 is blow molded or vacuum formed of a clear plastic material, e.g., polyethylene. In the figure shown, body 228 is substantially rectangular, however, where desired, pans having more curved surfaces may be employed. The side surfaces of the pan taper inwardly toward the base to permit stacking, and the pans are disposable.

The bottom surface 232 of pan 226 is disturbed by upwardly extending, about 0.5 inch, transversely arrayed ridges or baffles 234, which serve to quell sloshing and wave motion of fluid waste within the pan, in part by breaking the free flow area in the pan into a number of much smaller portions. A light gauge, yet very strong plastic bag 236 is placed with its sealed end in pan 226. The bag material is sufficiently compliant to conform closely to baffles 234, particularly under the weight of fluid waste, to permit the baffling effect to occur while providing a compact, easily disposable receiver for the patient's waste.

The lip 238 of bag 236 extends upward through elongated aperture 52 of plate 22 along the side surfaces of cushion 20 in aperture 58, beneath downwardly extending rear and front flaps 114, 116 of absorbent sheet 26. The lip 228 is attached to the surface of cushion 20 or, as described earlier, is connected to sheet 26, in either case providing a complete protection against soiling of the cushion, plate or tray.

Disposed within bag 236, the tear open envelope 240 affixed to the bag inner surface approximately at the level of the fluid waste, in a deodorant wafer 242. Wafer 242 comprises a hydrophillic polymer, sponge-like carrier, e.g., of the type sold by W. R. Grace Company under the tradename HYPOL, impregnated with water, surfactant and a malodor counteractant fragrance, e.g., of the type W5120 sold by Shaw Mudge & Company of Stamford, Conn.

Bag 236 is provided with wafer 242 in sealed envelope 240. Immediately prior to use, tear strip 244 is removed to expose wafer 242 to the air. The bag is then placed in receptacle 224 which is positioned in the chair. Upon exposure to the air, the fragrance, which is volatile at room temperature, disperses to counteract the order of waste in the pan. As more waste is discharged, the liquid level reaches wafer 242 to cause the surfactant to cause release of the fragrance at an increased rate to overcome the odors generated. Each wafer contains sufficient fragrance to act for the entire period of use of the bag.

Whenever desired, the bag is simply removed and disposed of and a new bag, with envelope 240 open, is inserted in its place. The pan is reusable, if desired, and may also be washed.

Referring now to FIGS. 5 through 8, wearing apparel for use by incontinent patients is shown. Viewed from the front (FIGS. 5 and 6) the patient appears to be normally attired with no indication of the incontinent condition. However, as seen from the rear (FIGS. 5*a* and 6*a*), the apparel has strategically placed openings to allow incontinent patients to perform uncontrolled bodily evacuative functions without soiling their clothes. The female attire (18, FIGS. 5 and 5*a*) typically includes a smock or dress open at 151 from the waist down to the hem in the back, for approximately one-third of the circumference and a pair of undershorts with a crotch opening 153 extending from front to back adjacent the leg openings. Both the dress and shorts are closed by hook-and-loop (Velcro (trade mark)-type) fasteners placed to allow the patient to be clothed and unclothed while seated in the chair. For the dress, the fasteners 152 are down the back at the rear; for the undershorts, at both sides 154, from the waist to hem, along each leg, to allow the clothing to be slipped on from the front with minimum disturbance of the patient. The men's attire, (18' FIGS. 6 and 6*a*) typically includes shirt, pants and undershorts. The pants are open at 155 in the buttocks area, with fasteners at the rear waist area. The shirt tails are also cut away at 157 at the bottom, with fasteners 158 in the back. In FIG. 6*b*, undershorts 160, useful for both sexes, are shown with fasteners 154 undone to display elongated opening 153 designed to extend from the crotch rearward. In the remaining figures, the female and male attire is shown in sitting and erect positions.

Referring now to FIGS. 9 and 9*a*, another embodiment of the invention is shown. In this embodiment, the seat 20' and support plate 22' are of horseshoe configuration with gap 118 formed at the rear of seat 20', and a corresponding gap 120 formed at the rear of seat support 22'. The remaining seat surface provides adequate weight-distributing support for the patient while allowing the attending nurse easy access through the gaps to clean or otherwise attend to patient when required. To maintain support 22' rigid and level, adjustable gussets arms 124 are provided. The arms 124 pivot in support eyes 126, and are threaded at their lower ends 128 to receive adjustment sleeves 130 and lock nuts 132. The position of sleeves 130 on arms 124 are adjusted to rest on bolt heads 134 in vertical legs 136. (In wheelchair 15, the bolts form the axles for wheels 138.) The lower ends of sleeves 130 are machined to smoothly intersect the bolt head and leg for maximum support. Nut 132 is adjusted on arm 124 to lock the sleeve in position.

Another embodiment of the receptacle is also shown in FIG. 9. Plate 80'' and container 96'' are formed separately, container 96'' being configured to be slidably received in guides 140 of plate 80'.

We claim:

1. A wheelchair for an incontinent disabled person comprises an apertured seat disposed over a receptacle mounted to be removed from said wheelchair, said seat comprising an upper detachable compliant seat member defining said aperture and an underlying, substantially rigid plate in supporting relationship to and having an elongated aperture corresponding with that of said compliant seat member, said elongated apertures of said seat member and plate positioned to register with flow from the waste discharge passages of the person permanently seated-thereabove, and with said receptacle therebelow, said receptacle disposed in waste-receiving relationship to said person being constructed and arranged to hold fluid discharges of said person, the inner surface of said receptacle being specially formed with concave sides to direct laterally-moving fluid waste in said container in a generally upward direction, and means for thereafter directing said fluid downwardly to permit spillage or sloshing due to motion of said chair or the motion of removal of said receptacle for emptying, said receptacle being removable and replaceable via access means located below the level of the said support plate to enable emptying without disturbing said seated person, said receptacle having upper, sideways-directed portions slideably engaged for support with guides carried by said rigid plate.

2. The wheelchair or claim 1 wherein the side surfaces thereof are generally of cylindrical form and the end surfaces are generally of spherical form.

3. The wheelchair of claim 1 wherein said means for thereafter directing said fluid downward comprises a deflector disposed relative to said concave surfaces in a manner to oppose said upwardly directed motion of said fluid therefrom.

4. The wheelchair or claim 1 wherein said receptacle is comprised of separable components, at least one of said components being disposable.

5. The wheelchair of claim 4 wherein said disposable component comprises said container, and said container is configured and designed to be compactly stacked with a multiplicity of similarly configured containers.

* * * * *

UNITED STATES PATENT AND TRADEMARK OFFICE

CERTIFICATE OF CORRECTION

PATENT NO. : 4,550,455

DATED : November 5, 1985

INVENTOR(S) : Donald W. Carson, et al.

It is certified that error appears in the above-identified patent and that said Letters Patent are hereby corrected as shown below:

Col. 1, line 54, "chain" should be --chair--;

Col. 2, line 23, "4" should be --4b--;

Col. 2, line 25, "Fig. 4a is a side section" should be --Fig. 4a, Fig. 4c is a side section--;

Col. 3, line 3, "formations 32, 24" should be --formations 32, 34--;

Col. 3, line 19, "top of arms 28, 30, the" should be --top of arms 28, 30, and--;

Col. 4, line 7, "plate 22 and Z-guides" should be --plate 22 are Z-guides--;

Col. 4, line 9, "directly" should be --directed--;

Col. 4, line 11, "80 In the figures," should be --80. In the figures,--;

Col. 5, line 49, "from and rear edges" should be --front and rear edges--;

Col. 6, line 20, "of an 122" should be --of pan 122-;

Col. 7, line 51, change "the" to --in--;

UNITED STATES PATENT AND TRADEMARK OFFICE

CERTIFICATE OF CORRECTION

PATENT NO. : 4,550,455

DATED : November 5, 1985

INVENTOR(S) : Donald W. Carson, et al.

It is certified that error appears in the above-identified patent and that said Letters Patent are hereby corrected as shown below:

Col. 7, line 53, "in a deodorant" should be --is a deodorant--;

Col. 9, line 15, "to permit spillage" should be --to prevent spillage--.

Signed and Sealed this

*Eighteenth* Day of *March 1986*

[SEAL]

*Attest:*

DONALD J. QUIGG

*Attesting Officer*

*Commissioner of Patents and Trademarks*